US008342814B2

(12) United States Patent
Ford

(10) Patent No.: US 8,342,814 B2
(45) Date of Patent: Jan. 1, 2013

(54) DEBRIS REMOVAL APPARATUS FOR A PUMP AND METHOD

(76) Inventor: Michael Brent Ford, St. George, UT (US)

( * ) Notice: Subject to any disclaimer, the term of this patent is extended or adjusted under 35 U.S.C. 154(b) by 789 days.

(21) Appl. No.: 12/471,916

(22) Filed: May 26, 2009

(65) Prior Publication Data

US 2009/0304526 A1 Dec. 10, 2009

Related U.S. Application Data

(60) Provisional application No. 61/060,041, filed on Jun. 9, 2008.

(51) Int. Cl.
*F04B 43/12* (2006.01)

(52) U.S. Cl. ..... 417/53

(58) Field of Classification Search ..... 417/53–55
See application file for complete search history.

(56) References Cited

U.S. PATENT DOCUMENTS

2006/0083646 A1* 4/2006 Ford ..... 417/555.1
2007/0209147 A1* 9/2007 Krebs et al. ..... 15/347

* cited by examiner

*Primary Examiner* — Anh Mai
*Assistant Examiner* — Hana Featherly
(74) *Attorney, Agent, or Firm* — Weiss & Moy, P.C.; Jeffrey D. Moy

(57) ABSTRACT

A pump apparatus includes a gear pump assembly interposed between top and bottom drive gear assemblies, and coupler assemblies interposed between a bottom of the top drive gear assembly and a top of the gear pump assembly, and between a top of the bottom drive gear assembly and a bottom of the gear pump assembly. The drive assemblies rotate a pre-feed auger. A cyclone screen located within a cyclone housing is positioned over a shaft of the pre-feed auger and interposed between a blade of the pre-feed auger and the bottom drive gear assembly. An intake housing is positioned over the blade of the pre-feed auger, and regulates fluid intake into the pump.

20 Claims, 11 Drawing Sheets

DEBRIS REMOVAL APPARATUS FOR A PUMP AND METHOD

RELATED APPLICATION

This non-provisional application claims priority from provisional application No. 61/060,041, filed on Jun. 9, 2008.

FIELD OF THE INVENTION

The present invention relates to pumping apparatuses and, more particularly, to a debris removal apparatus for a pump operating in certain conditions in which a relatively high concentration of solids is present, such as a pump operating to remove heavy crude oil.

BACKGROUND OF THE INVENTION

Oil well and other fluid pumping systems are well known in the art. Such oil well pumping systems are used to mechanically remove oil or other fluid from beneath the earth's surface, particularly when the natural pressure in an oil well has diminished. Generally, an oil well pumping system begins with an above-ground pumping unit, which may commonly be referred to as a "pumpjack," "nodding donkey," "horsehead pump," "beam pump," "sucker rod pump," and the like. The pumping unit creates a reciprocating (up and down) pumping action that moves the oil (or other substance being pumped) out of the ground and into a flow line, from which the oil is then taken to a storage tank or other such structure.

Below the ground, a shaft is lined with piping known as "tubing." Into the tubing is inserted a string of sucker rods, which ultimately is indirectly coupled at its north end to the above-ground pumping unit. The string of sucker rods is ultimately indirectly coupled at its south end to a subsurface or "down-hole" pump that is located at or near the fluid in the oil well. The subsurface pump has a number of basic components, including a barrel and a plunger. The plunger operates within the barrel, and the barrel, in turn, is positioned within the tubing. It is common for the barrel to include a standing valve and the plunger to include a traveling valve. The standing valve has a ball therein, the purpose of which is to regulate the passage of oil from down-hole into the pump, allowing the pumped matter to be moved northward out of the system and into the flow line, while preventing the pumped matter from dropping back southward into the hole. Oil is permitted to pass through the standing valve and into the pump by the movement of the ball off its seat, and oil is prevented from dropping back into the hole by the seating of the ball. North of the standing valve, coupled to the sucker rods, is the traveling valve. The traveling valve regulates the passage of oil from within the pump northward in the direction of the flow line, while preventing the pumped oil from dropping back southward, in the direction of the standing valve and hole.

Actual movement of the pumped substance through the system will now be discussed. Oil is pumped from a hole through a series of downstrokes and upstrokes of the pump, which motion is imparted by the above-ground pumping unit. During the upstroke, formation pressure causes the ball in the standing valve to move upward, allowing the oil to pass through the standing valve and into the barrel of the oil pump. This oil will be held in place between the standing valve and the traveling valve. In the traveling valve, the ball is located in the seated position, held there by the pressure from the oil that has been previously pumped.

On the downstroke, the ball in the traveling valve unseats, permitting the oil that has passed through the standing valve to pass therethrough. Also during the downstroke, the ball in the standing valve seats, preventing pumped oil from moving back down into the hole. The process repeats itself again and again, with oil essentially being moved in stages from the hole, to above the standing valve and in the oil pump, to above the traveling valve and out of the oil pump. As the oil pump fills, the oil passes through the pump and into the tubing. As the tubing is filled, the oil passes into the flow line, and is then taken to the storage tank or other such structure.

There are a number of problems that are regularly encountered during fluid pumping operations. Fluid that is pumped from the ground is generally impure, and includes solid impurities such as sand, pebbles, limestone, and other sediment and debris. Certain kinds of pumped fluids, such as heavy crude, tend to contain a relatively large amount of solids.

Solid impurities may be harmful to a pumping apparatus and its components for a number of reasons. For example, sand can become trapped between pump components, causing damage, reducing effectiveness, and sometimes requiring a halt to pumping operations and replacement of the damaged component(s). This can be both time consuming and expensive.

One prior art solution has been the use of a progressive cavity pump, known as a PCP. However, a PCP utilizes an elastomeric stator, and is therefore unable to maintain quality in high temperature operation, as is generally required in the pumping of heavy crude. Further, PCPs typically are not very tolerant of solids, and may have a short lifespan when pumping fluids containing abrasive solids. In addition, when pumping against high pressures, PCPs generally are required to be relatively lengthy, and accordingly, can be expensive.

The present invention addresses these problems encountered in prior art pumping systems and provides other, related, advantages.

SUMMARY OF THE INVENTION

In accordance with an embodiment of the present invention, a debris removal apparatus for a pumping system is disclosed. The debris removal apparatus comprises, in combination: a top drive gear assembly; a bottom drive gear assembly; a gear pump assembly interposed between the top drive gear assembly and the bottom drive gear assembly; an auger having one of a blade and a plurality of round plates; a cyclone housing positioned over a shaft of the auger and adapted to contain a cyclone screen, wherein the cyclone housing is interposed between a portion of the auger and the bottom drive gear assembly; a cyclone screen positioned within the cyclone housing; and an intake housing positioned over a portion of the auger, wherein the intake housing includes at least one intake port.

In accordance with another embodiment of the present invention, a debris removal apparatus for a pumping system is disclosed. The debris removal apparatus comprises, in combination: a top drive gear assembly located at a northern end of the debris removal apparatus; a bottom drive gear assembly; a gear pump assembly interposed between the top drive gear assembly and the bottom drive gear assembly, wherein the gear pump assembly comprises at least two gears, wherein the gears include teeth, the teeth having cavities adapted to trap debris therein; a plurality of coupler assemblies, wherein a first coupler assembly is interposed between a bottom of the top drive gear assembly and a top of the gear pump assembly, and a second coupler assembly is interposed between a top of the bottom drive gear assembly and a bottom of the gear pump assembly; an auger; a transmission housing positioned at a north end of the auger; an opening positioned proximate the transmission housing, wherein the opening is adapted to permit gasses to be ejected therethrough; a cyclone housing positioned over a shaft of the auger and adapted to contain a cyclone screen, wherein the cyclone housing is interposed between a blade of the auger and the bottom drive gear assembly; a cyclone screen positioned within the cyclone housing, wherein the cyclone includes a plurality of openings adapted to permit solids to be expelled therethrough; and an intake housing located at a southern end of the debris removing apparatus and positioned over the blade of the auger, wherein the intake housing includes a plurality of equidistantly spaced intake ports.

In accordance with a further embodiment of the present invention, a method for pumping fluid is disclosed. The method comprises the steps of: providing a debris removal apparatus for a pumping system comprising, in combination: a top drive gear assembly; a bottom drive gear assembly; a gear pump assembly interposed between the top drive gear assembly and the bottom drive gear assembly; an auger; a cyclone housing positioned over a shaft of the auger and adapted to contain a cyclone screen, wherein the cyclone housing is interposed between a blade of the auger and the bottom drive gear assembly; a cyclone screen positioned within the cyclone housing; and an intake housing positioned over the blade of the auger, wherein the intake housing includes at least one intake port; utilizing the debris removal apparatus, pumping fluid; wherein the fluid enters the intake housing, then enters an interior portion of the cyclone screen; causing solids entrained in the fluid to exit the cyclone screen through openings in the cyclone screen, to then pass through a length of exhaust channels, to then exit the debris removal apparatus; wherein the fluid then passes through the bottom drive gear assembly, then enters the gear pump assembly; and wherein a portion of the fluid then enters the top drive gear assembly.

DETAILED DESCRIPTION OF THE PREFERRED EMBODIMENTS

Figure 1:
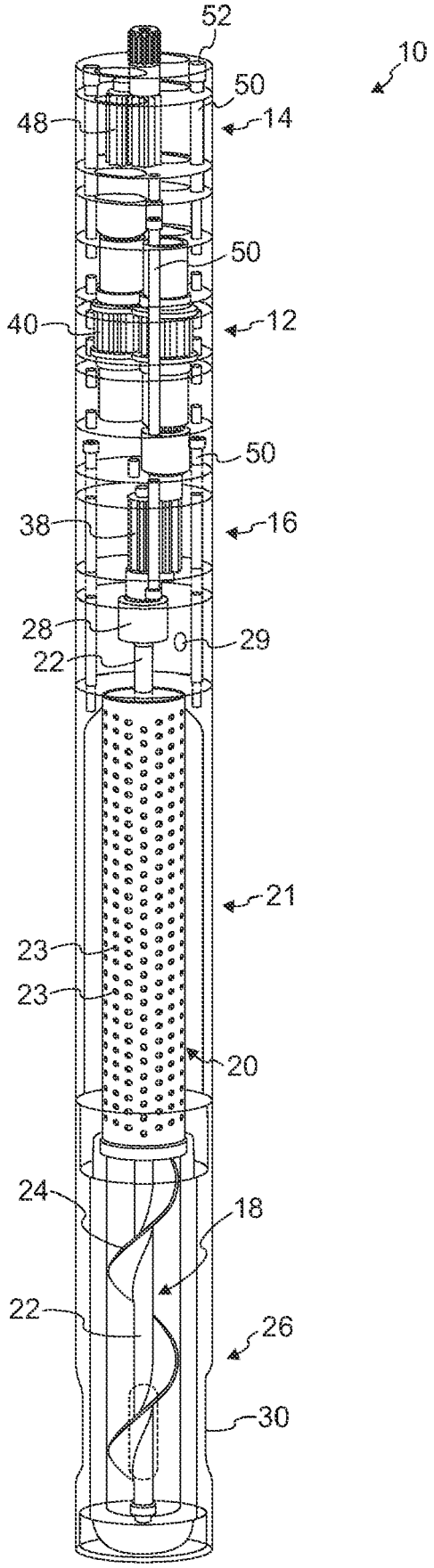
FIG. 1 is a side, internal view of a debris removing apparatus consistent with an embodiment of the present invention.
Figure 2:
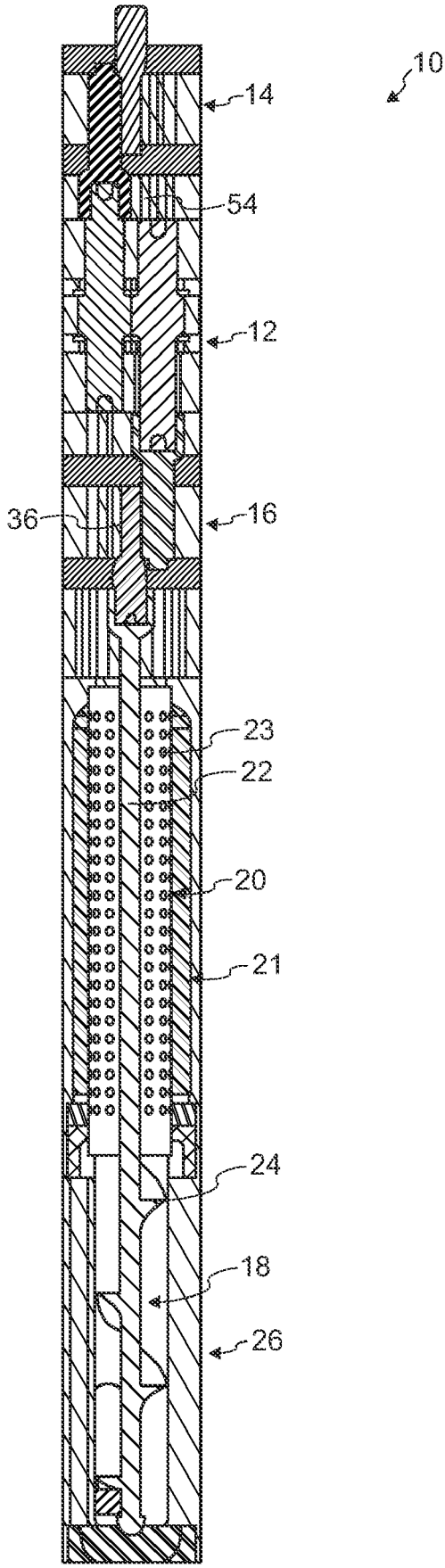
FIG. 2 is a side, cut-away view of the debris removing apparatus of FIG. 1.
Figure 3:
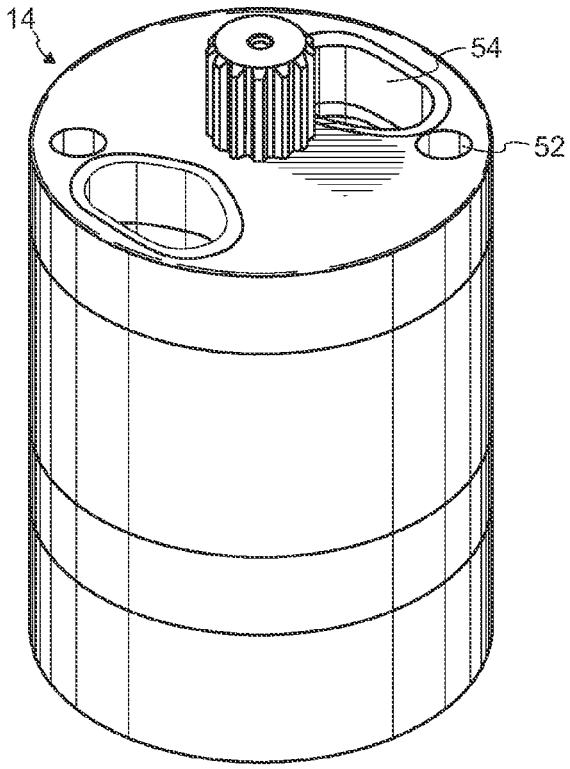
FIG. 3 is a perspective view of a top drive gear assembly component of the debris removing apparatus of FIGS. 1-2.
Figure 4:
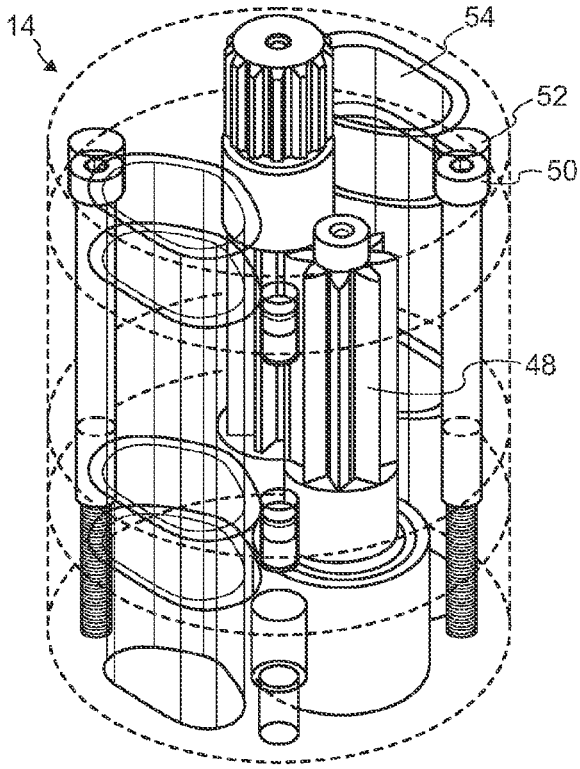
FIG. 4 is a perspective, internal view of the top drive gear assembly of FIG. 3.
Figure 5:
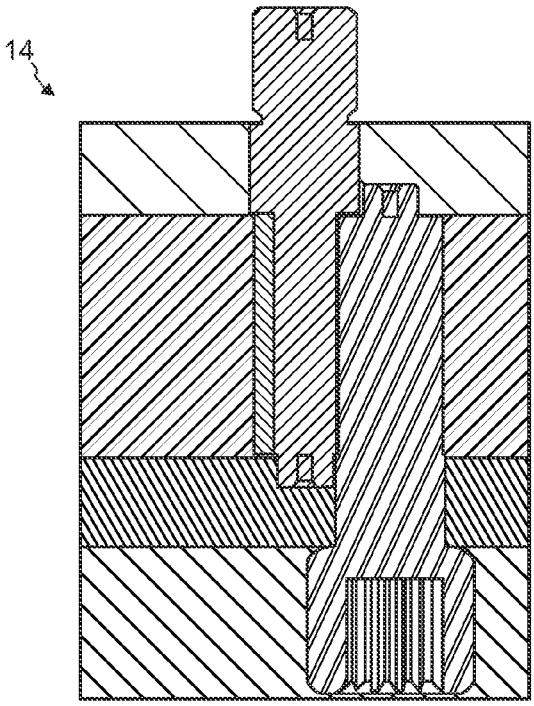
FIG. 5 is a side, cross-sectional view of the top drive gear assembly of FIG. 3.
Figure 21:
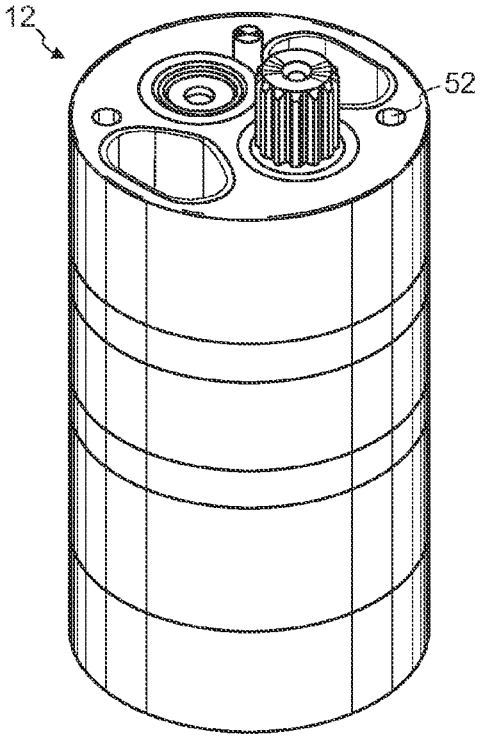
FIG. 21 is a perspective view of a gear pump assembly component of the debris removing apparatus of FIGS. 1-2.
Figure 22:
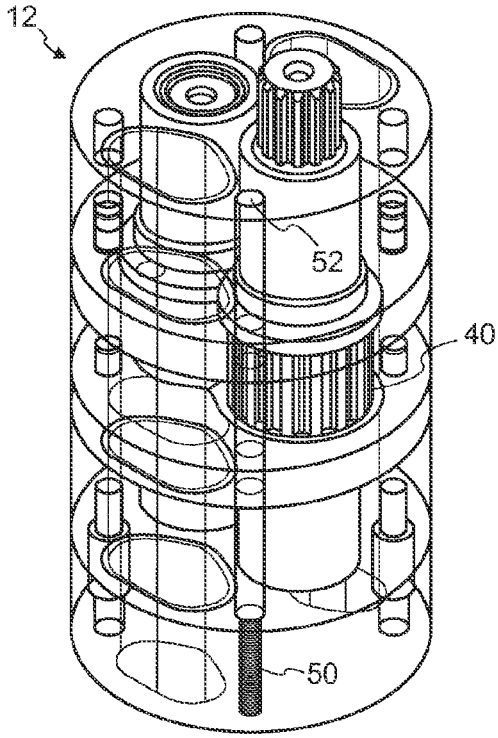
FIG. 22 is a perspective, cut-away view of the gear pump assembly of FIG. 21.
Figure 23:
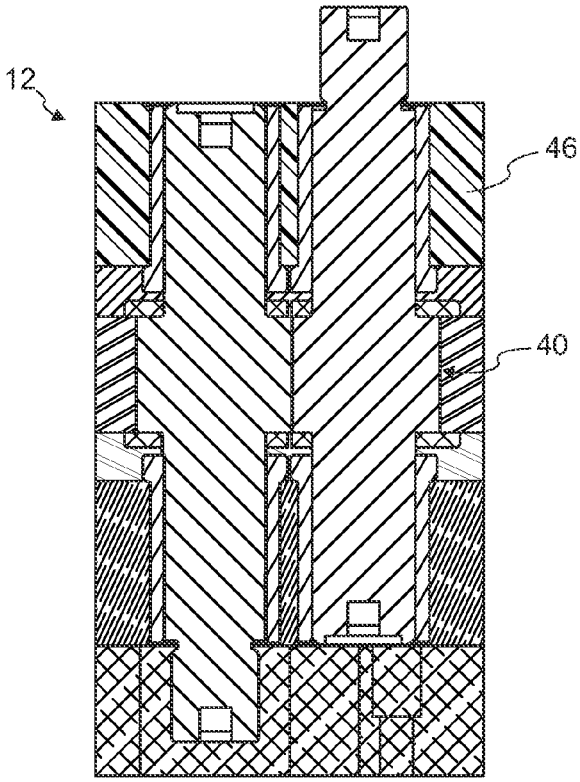
FIG. 23 is a side, cross-sectional view of the gear pump assembly of FIG. 21.
Figure 24:
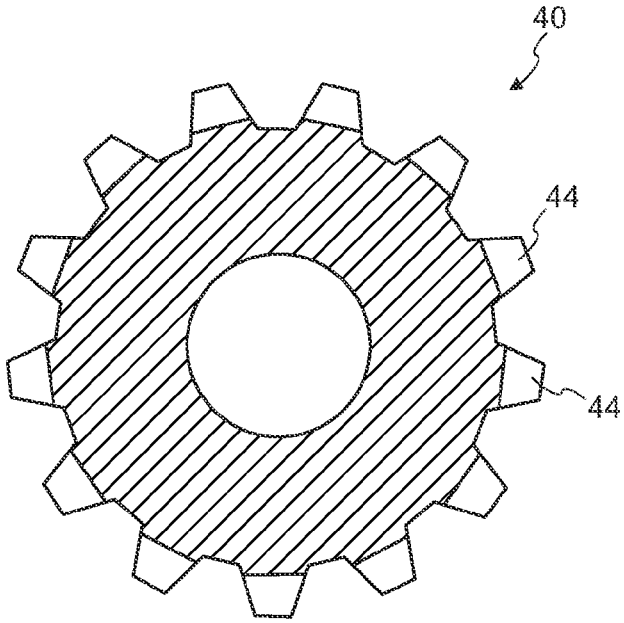
FIG. 24 is a bottom end view of a pump gear component of the gear pump assembly of FIG. 21.

Referring first to FIGS. 1-2, a pump apparatus 10 ("pump 10") consistent with an embodiment of the present invention is shown. Beginning with the principal components of the pump 10, a gear pump assembly 12 (as shown in more detail in FIGS. 21-23) is interposed between a top drive gear assembly 14 (as shown in more detail in FIGS. 3-5) and a bottom drive gear assembly 16. (A coupler assembly is interposed between a bottom of the top drive gear assembly 14 and a top of the gear pump assembly 12, and a coupler assembly is also interposed between a top of the bottom drive gear assembly 16 and a bottom of the gear pump assembly 12.) The top drive gear assembly 14 may be located at a northern end of the pump 10. In one embodiment, the principal components of the pump 10 may be coupled together with bolts 50, which may be inserted in openings 52 provided in the gear pump assembly 12, top drive gear assembly 14, and bottom drive gear assembly 16. In this way, the principal components of the pump 10 may be properly aligned with one another. It may be desired to employ lag bolts, shoulder bolts, pins, or some other suitable device for purposes of coupling together the different components of the pump 10. It should be noted that, for certain embodiments, it may be desired to provide more than one gear pump assembly 12, which may be stacked. This may be desired in situations where, for example, there may be a need to transfer a greater amount of fluid over a given timeframe than one gear pump assembly 12 may be capable of transferring.

Preferably, the gear pump assembly 12, top drive assembly 14, and bottom drive assembly 16 have outer dimensions appropriate for use with a given pipe into which the pump 10 may be inserted. For example, in one embodiment, the gear pump assembly 12, top drive assembly 14, and bottom drive assembly 16 may have outer dimensions of approximately 3¾ inches, such that they may be adapted for use with a 6-inch pipe. This helps to ensure that the annular space between the pipe and the pump 10 is sufficient to permit fluid to pass therethrough as it is being pumped. The gear pump assembly 12, top drive assembly 14, and bottom drive assembly 16 may have other outer dimensions, such as approximately 5 inches, approximately 6 inches, or some other desired dimensions, depending on the dimensions of the pipe with which the pump 10 is to be employed.

Figure 11:
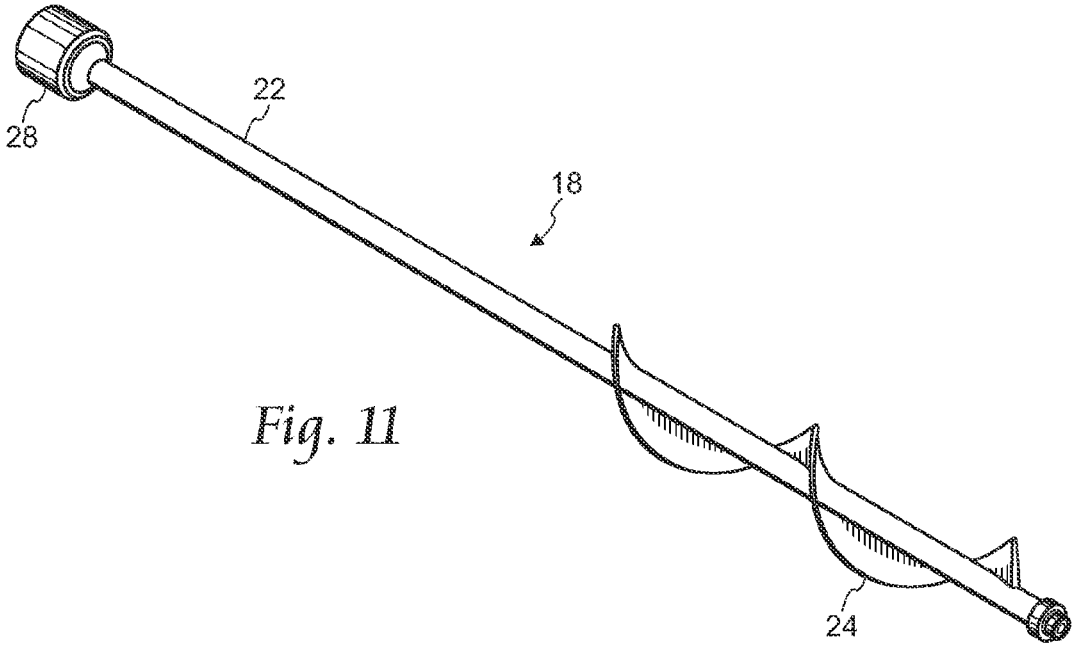
FIG. 11 is a perspective view of a pre-feed auger component of the debris removing apparatus of FIGS. 1-2.
Figure 12:
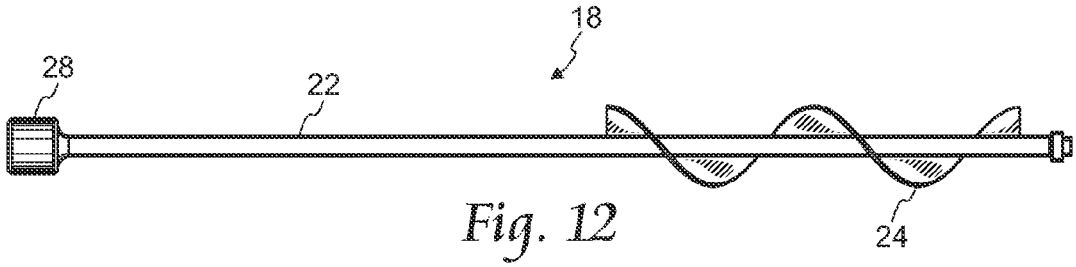
FIG. 12 is a side view of the pre-feed auger of FIG. 11.
Figure 13:
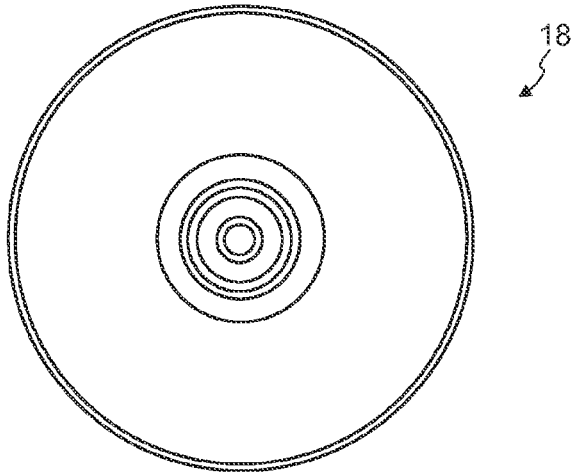
FIG. 13 is a top end view of the pre-feed auger of FIG. 11.
Figure 14:
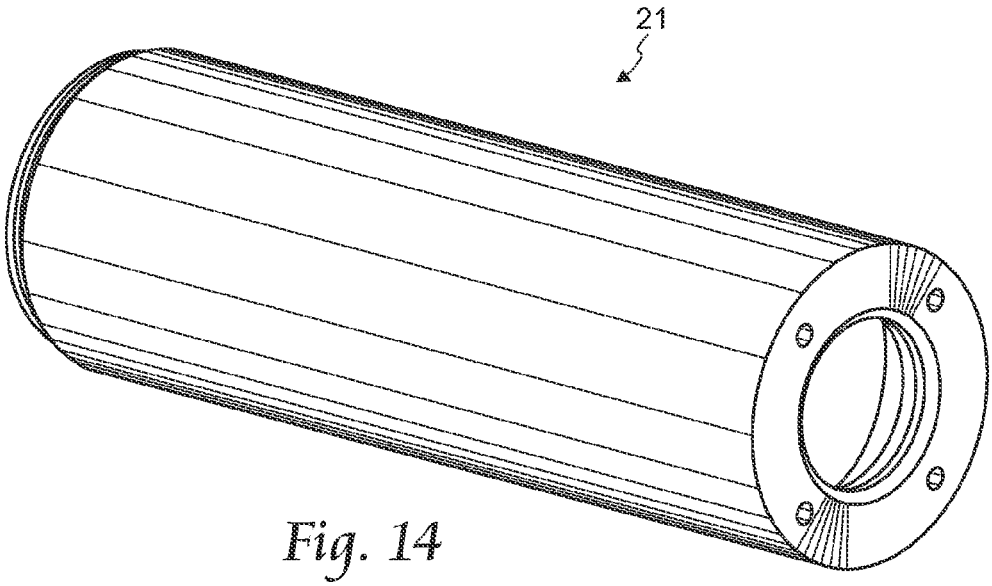
FIG. 14 is a perspective view of a cyclone housing component of the debris removing apparatus of FIGS. 1-2.
Figure 15:
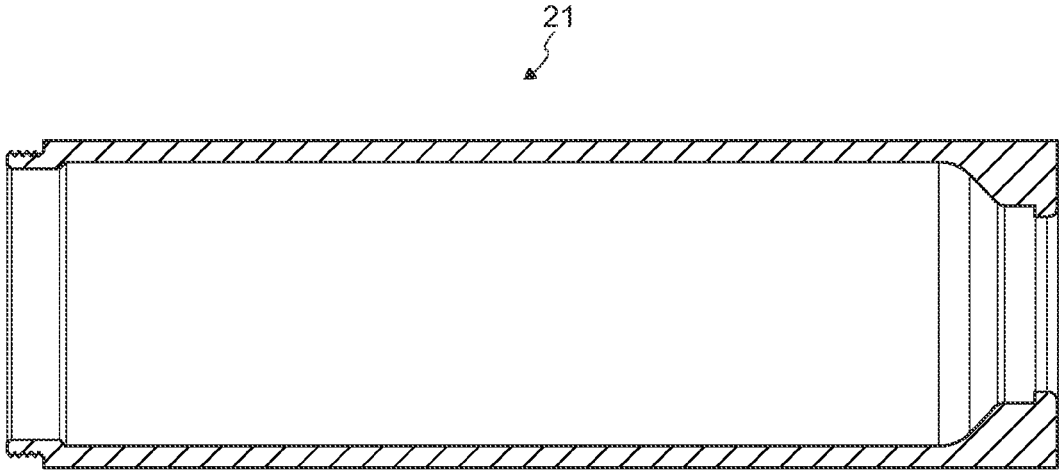
FIG. 15 is a side, cross-sectional view of the cyclone housing of FIG. 14.
Figure 16:
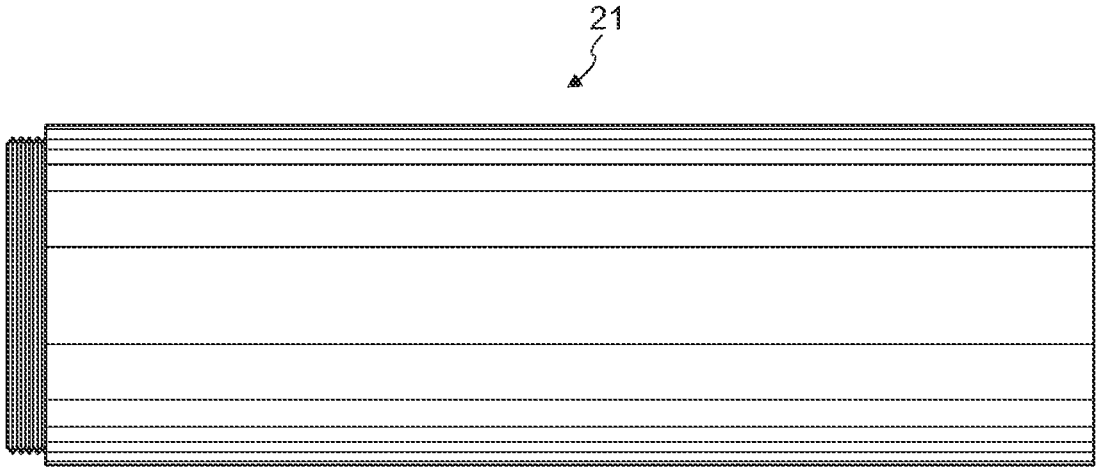
FIG. 16 is a side view of the cyclone housing of FIG. 14.
Figure 17:
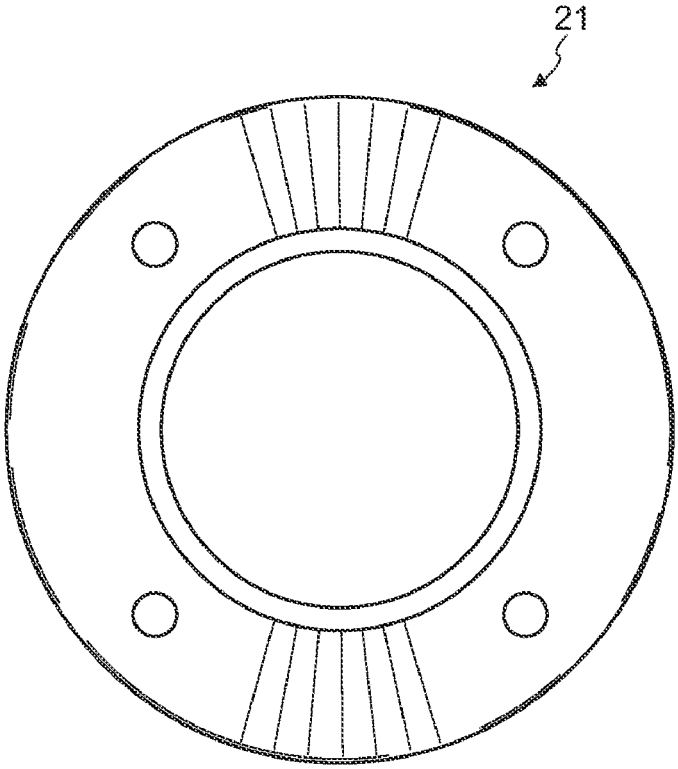
FIG. 17 is an end view of the cyclone housing of FIG. 14.
Figure 18:
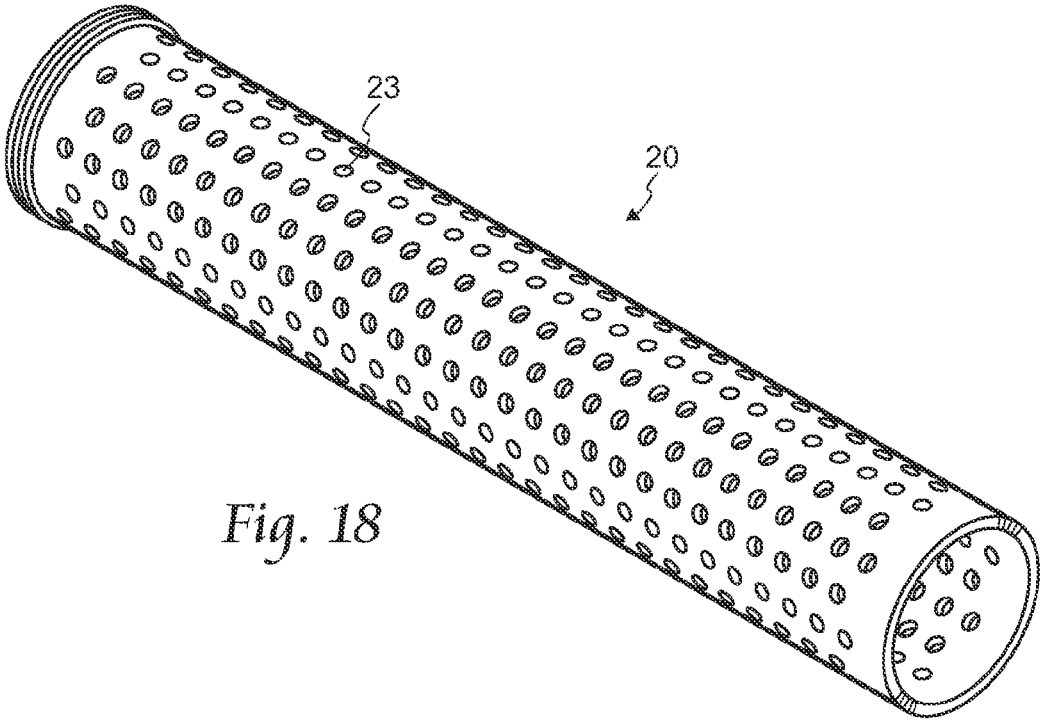
FIG. 18 is a perspective view of a cyclone screen component of the debris removing apparatus of FIGS. 1-2.
Figure 19:
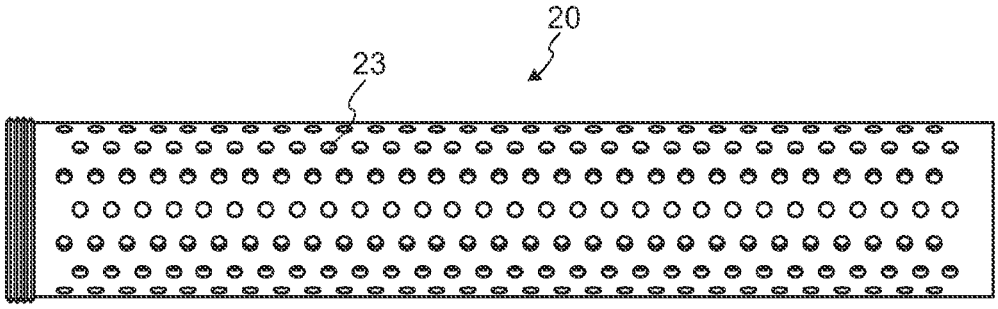
FIG. 19 is a side view of the cyclone screen of FIG. 18.
Figure 20:
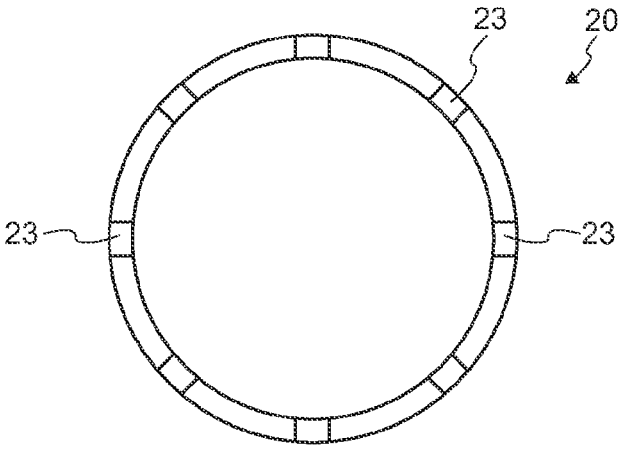
FIG. 20 is an end view of the cyclone screen of FIG. 18.

Continuing with a summary of the principal components of the pump 10, the drive assemblies 14 and 16 rotate a pre-feed auger 18 (as shown in more detail in FIGS. 11-13). A cyclone screen 20 (as shown in more detail in FIGS. 18-20) located within a cyclone housing 21 (as shown in more detail in FIGS. 14-17) is positioned over a shaft 22 of the pre-feed auger 18 and interposed between a blade 24 of the pre-feed auger 18 and the bottom drive gear assembly 16. While in this embodiment the pre-feed auger 18 with a radial-configured blade 24 is employed, it may be desired, for other embodiments, to incorporate round plates on the pre-feed auger 18, such as those that may be found on Tesla pumps or the like, as an alternative to radial-configured blade 24. Such round plates would use shear forces to move fluid. An intake housing 26 (as shown in more detail in FIGS. 6-10) is positioned over the blade 24 of the pre-feed auger 18, and regulates fluid intake into the pump 10. The intake housing 26 may be located at a southern end of the pump 10. The entire pump 10 may be coupled, at a north end thereof, to a hydraulic pump, hydraulic motor, electric motor, or drive rod/shaft powered at the surface. When the pump 10 is coupled to a hydraulic motor, for example, it may be useful for cleaning power fluid that is used to drive a hydraulic motor in coil tubing operations and the like.

Turning more specifically to the top and bottom drive gear assemblies 14 and 16, they cooperate to turn the pre-feed auger 18 at a desired rpm. In one embodiment, the top drive gear assembly 14 rotates at a first rpm, for example 450 rpm, and the bottom drive gear assembly 16 rotates at a lower rpm, for example 400 rpm. It may be permitted, for certain sizes of the pre-feed auger 18, to provide a top drive gear assembly 14 and a bottom drive gear assembly 16 that are both rotating at the same rpm.

As noted above, the pre-feed auger 18 is rotated by the combined operation of the top and bottom drive gear assemblies 14 and 16. Rotational movement of the top drive gear assembly 14 is communicated to the bottom drive gear assembly 16 through the gear pump assembly 12, and the bottom drive gear assembly 16 is coupled to a transmission housing 28 (as shown in more detail in FIGS. 11-12) located on the pre-feed auger 18. Preferably, the transmission housing 28 is positioned at a north end of the pre-feed auger 18. In one embodiment, it may be desired to include an opening 29 in the pump 10, proximate the transmission housing 28, to permit gasses to be ejected therethrough during pumping operations, thereby preventing the pump 10 from becoming gas-locked. It should be noted that, for certain embodiments, it may be desired for the opening 29 to be omitted.

Referring now to the intake housing 26, as seen in FIGS. 1-2, it is positioned at a southern end of the pump 10, and houses the pre-feed auger 18. The intake of fluid into the pump 10 occurs through intake ports 30, located around the intake housing 26. In one embodiment, there are four intake ports 30, located equidistantly around a circumference of the intake housing 26. It should be noted that, for certain embodiments, it may be desired to provide more than four or less than four intake ports 30.

A pumping of fluid through pump 10 will now be described. Fluid from a formation enters intake ports 30. The pre-feed auger 18, which will be spinning at a faster rate than the turning of the individual top and bottom drive gear assemblies 14 and 16, forces the fluid northward within the pump 10. This has the effect of pressurizing the fluid intake, preloading the pump 10. This prevents the pump 10 from starving/cavitating during operation, since the pump 10 does not depend on gravity to move fluid therethrough. It also creates residence time for the pumped fluid to move from the pre-feed auger 18 to the intake for the gear pump assembly 12.

Figure 6:
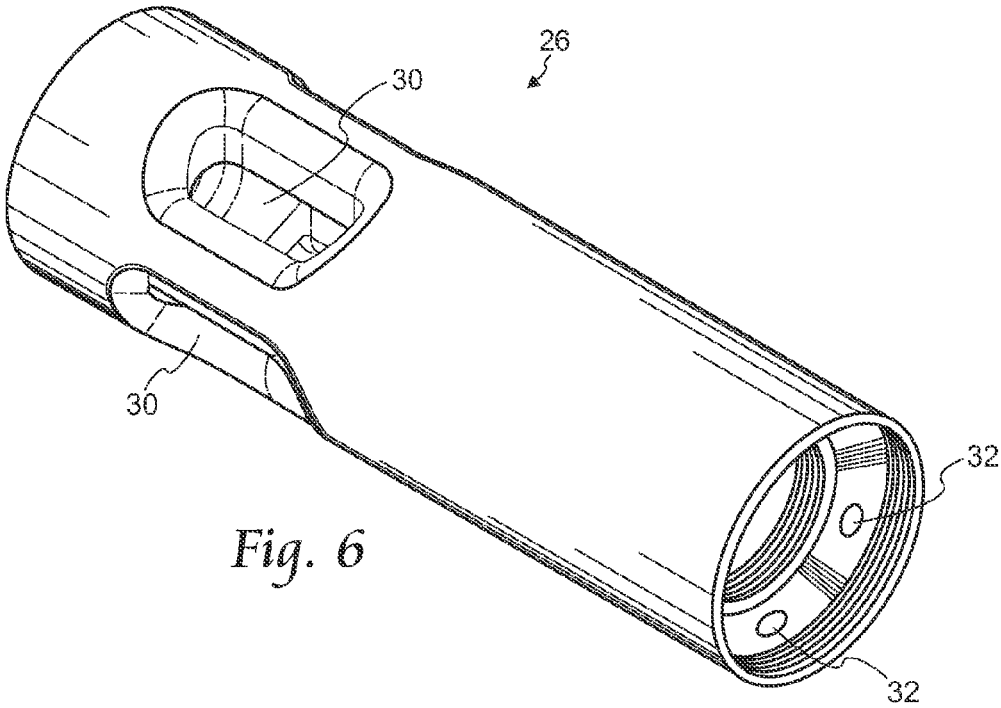
FIG. 6 is a perspective view of an intake housing component of the debris removing apparatus of FIGS. 1-2.
Figure 7:
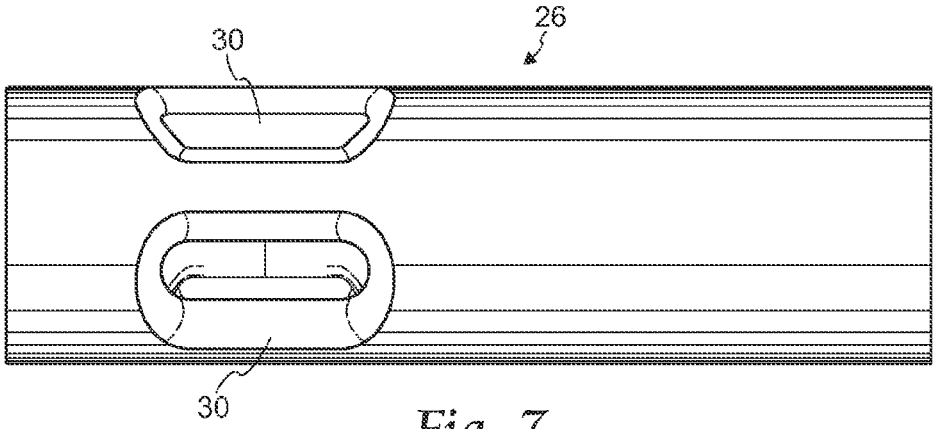
FIG. 7 is a side view of the intake housing of FIG. 6.
Figure 8:
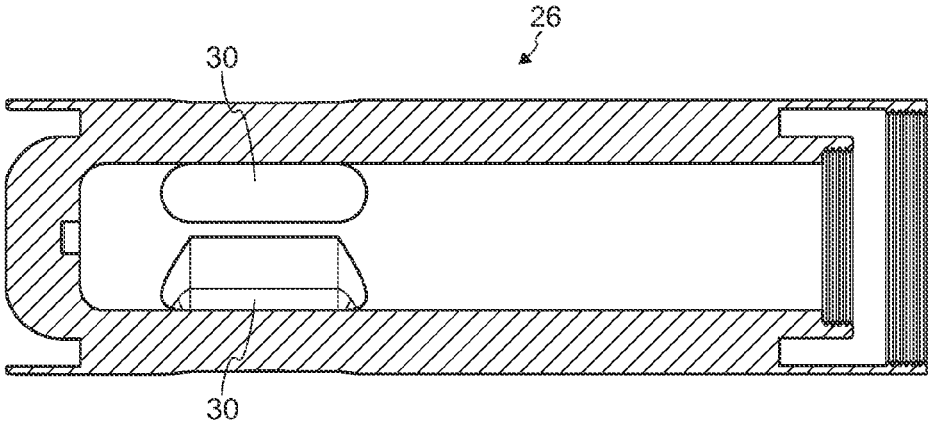
FIG. 8 is a side, cut-away view of the intake housing of FIG. 6.
Figure 9:
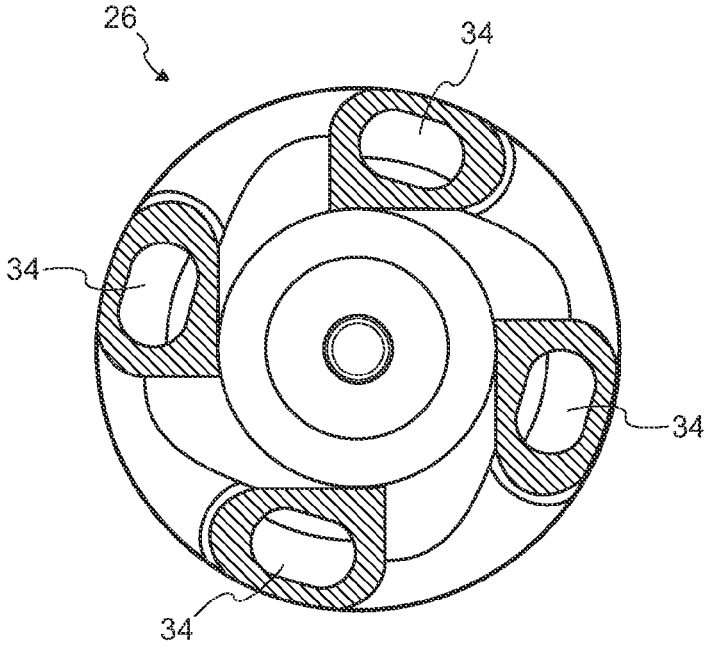
FIG. 9 is a bottom view of the intake housing of FIG. 6.
Figure 10:
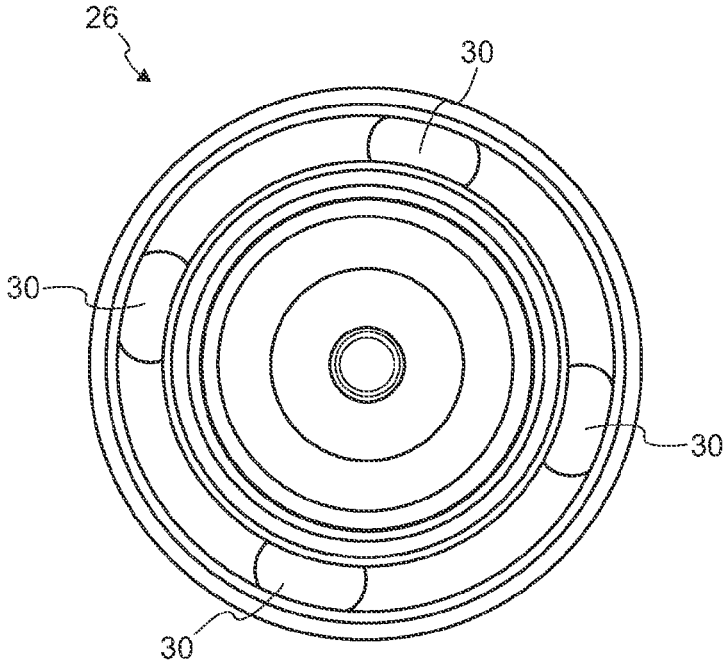
FIG. 10 is a top view of the intake housing of FIG. 6.
Figure 25:
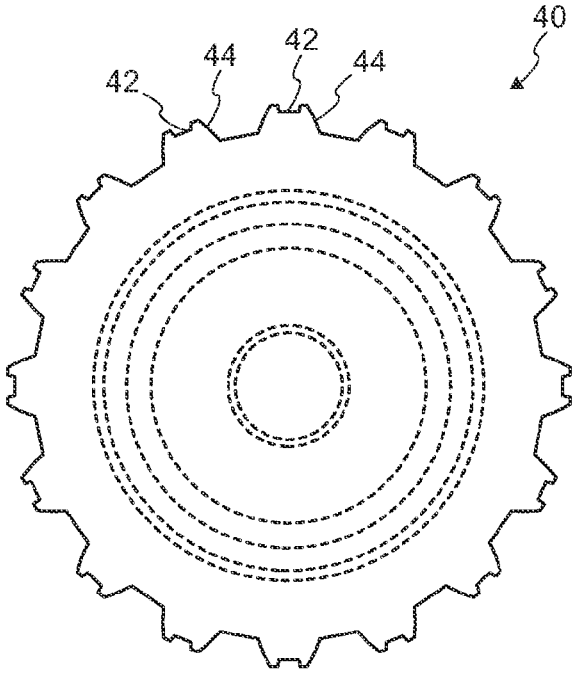
FIG. 25 is a top end view of a pump gear component of the gear pump assembly of FIG. 21.

Because of the action of the pre-feed auger 18, the pumped fluid is spinning as it travels northward above the pre-feed auger 18 and into the interior of the cyclone screen 20. As the fluid spins, solids in the fluid are moved toward the cyclone screen 20, and are permitted exit via openings 23 in the cyclone screen 20. Solids that have exited the cyclone screen 20 via openings 23 enter a space between the cyclone screen 20 and the cyclone housing 21, and are permitted to drop into an upper portion of the intake housing 26, where they will enter exhaust channels 32 (as shown in FIG. 6) located therein. After passing through a length of exhaust channels 32, solids exit via exhaust ports 34 (as shown in FIG. 9). The exhaust channels 32 and intake ports 30 are offset in relation to each other, so that the exhaust channels may extend continuously from a top portion of the intake housing 26 to a bottom portion thereof, where solids may exit via exhaust ports 34. In one embodiment, four exhaust channels 32 and four exhaust ports 34 are included. However, it should be noted that, for certain embodiments, it may be desired to vary the number of exhaust channels 32 and exhaust ports 34, such that more than four or less than four exhaust channels 32 and exhaust ports 34 are included. Fluid that travels northward through the cyclone screen 20, after removal of solids through the openings 23 in the cyclone screen 20, passes through ports 36 in the bottom drive gear assembly 16, bypassing the gears 38. The fluid then enters the gear pump assembly 12, and passes between and around the gears 40 (as shown in FIGS. 22-25). Referring now to FIG. 25, it can be seen that in one embodiment, cavities 42 are provided on individual teeth 44 of gears 40 of the gear pump assembly 12. Solids present in the pumped fluid as it passes through the gear pump assembly 12 may be trapped in the cavities 42, reducing the risk of damage to the gears 40. In addition, pumped fluid that may be captured between gears 40 and stator 46 (FIG. 23) is forced out through discharge.

It should be noted that the gear pump assembly 12 pumps the fluid at a slower rate than the pre-feed auger 18. In one embodiment, the pre-feed auger 18 may pump twice as much fluid as the gear pump assembly 12. For example, the gear pump assembly 12 may be configured to pump fluid at a rate of 50 gallons per minute while the pre-feed auger 18 may be configured to pump fluid at a rate of 100 gallons per minute. The fluid pumped by the pre-feed auger 18 will pass northward into the cyclone screen 20 as described above. The pumped fluid that is beyond the capacity of the gear pump assembly 12, with removed solids entrained therein, will travel back down the pump via the cyclone housing 21 and the exhaust channels 32, before exiting the pump 10 via exhaust ports 34. As can be seen from this description, configuring the pre-feed auger 18 to pump at a faster rate than the gear pump assembly 12 permits removal of solids prior to their entry into the gear pump assembly 12.

Continuing with the description of the pumping of fluid through the pump 10, the pumped fluid that is not beyond the capacity of the gear pump assembly 12 will travel northward toward the top drive gear assembly 14, passing through ports 54 therein, bypassing gears 48. Thereafter, the pumped fluid will continue travelling northward, eventually reaching the tubing.

The pump 10 may be configured such that its overall length is substantially smaller than typical prior art pumps, such as PCPs. For example, in one embodiment, the pump 10 may be configured to range from approximately three to six or more feet in length, or some other preferred length. This is in contrast to typical PCPs, which may be up to forty or more feet in length, for example. By virtue of the length of the pump 10, it may be adapted for placement in subsurface areas that have been drilled both vertically and laterally.

While the invention has been particularly shown and described with reference to preferred embodiments thereof, it will be understood by those skilled in the art that the foregoing and other changes in form and details may be made therein without departing from the spirit and scope of the invention. For example, while various components of the invention have been described with reference to various dimensions thereof, it will be recognized by those skilled in the art that substantial benefit could be derived from alternative configurations of the invention in which different dimensions are employed, including those that deviate from the preferred dimensions, even substantially, in either direction.

I claim:

1. A debris removal apparatus for a pumping system comprising, in combination:

a top drive gear assembly;

a bottom drive gear assembly;

a gear pump assembly interposed between the top drive gear assembly and the bottom drive gear assembly;

an auger having one of a blade and a plurality of round plates, wherein the top gear assembly and the bottom gear assembly rotate the auger;

a cyclone housing positioned over a shaft of the auger and adapted to contain a cyclone screen, wherein the cyclone housing is interposed between a portion of the auger and the bottom drive gear assembly;

the cyclone screen positioned within the cyclone housing; and an intake housing positioned over a portion of the auger, wherein the intake housing includes at least one intake port.

2. The debris removal apparatus of claim 1 further comprising a transmission housing positioned at a north end of the auger.

3. The debris removal apparatus of claim 2 further comprising an opening positioned proximate the transmission housing, wherein the opening is adapted to permit gasses to be ejected therethrough.

4. The debris removal apparatus of claim 1 adapted to be coupled at a north end thereof to one of a hydraulic pump, hydraulic motor, electric motor, drive rod and drive shaft.

5. The debris removal apparatus of claim 1 further comprising a plurality of coupler assemblies, wherein a first coupler assembly is interposed between a bottom of the top drive gear assembly and a top of the gear pump assembly, and a second coupler assembly is interposed between a top of the bottom drive gear assembly and a bottom of the gear pump assembly.

6. The debris removal apparatus of claim 1 wherein the top drive gear assembly, bottom drive gear assembly, and gear pump assembly each include a plurality of openings, wherein the openings are adapted to receive one of a plurality of lag bolts, shoulder bolts and pins, such that the top drive gear assembly, bottom drive gear assembly, and gear pump assembly may be aligned with one another.

7. The debris removal apparatus of claim 1 comprising a plurality of gear pump assemblies, wherein the gear pump assemblies are stacked.

8. The debris removal apparatus of claim 1 wherein the top drive assembly, bottom drive assembly, and gear pump assembly have outer dimensions of approximately 3¾ to 6 inches.

9. The debris removal apparatus of claim 1 wherein the intake housing includes four intake ports.

10. A debris removal apparatus for a pumping system comprising, in combination:

a top drive gear assembly located at a northern end of the debris removal apparatus;

a bottom drive gear assembly;

a gear pump assembly interposed between the top drive gear assembly and the bottom drive gear assembly, wherein the gear pump assembly comprises at least two gears, wherein the gears include teeth, the teeth having cavities adapted to trap debris therein;

a plurality of coupler assemblies, wherein a first coupler assembly is interposed between a bottom of the top drive gear assembly and a top of the gear pump assembly, and a second coupler assembly is interposed between a top of the bottom drive gear assembly and a bottom of the gear pump assembly;

an auger;

a transmission housing positioned at a north end of the auger;

an opening positioned proximate the transmission housing, wherein the opening is adapted to permit gasses to be ejected therethrough;

a cyclone housing positioned over a shaft of the auger and adapted to contain a cyclone screen, wherein the cyclone housing is interposed between a blade of the auger and the bottom drive gear assembly;

a the cyclone screen positioned within the cyclone housing, wherein the cyclone includes a plurality of openings adapted to permit solids to be expelled therethrough; and an intake housing located at a southern end of the debris removing apparatus and positioned over the blade of the auger, wherein the intake housing includes a plurality of equidistantly spaced intake ports.

11. The debris removal apparatus of claim 10 adapted to be coupled at a north end thereof to one of a hydraulic pump, hydraulic motor, electric motor, drive rod and drive shaft.

12. The debris removal apparatus of claim 10 wherein the top drive gear assembly, bottom drive gear assembly, and gear pump assembly each include a plurality of openings, wherein the openings are adapted to receive one of a plurality of lag bolts, shoulder bolts and pins, such that the top drive gear assembly, bottom drive gear assembly, and gear pump assembly may be aligned with one another.

13. The debris removal apparatus of claim 10 comprising a plurality of gear pump assemblies, wherein the gear pump assemblies are stacked.

14. The debris removal apparatus of claim 10 wherein the top drive assembly, bottom drive assembly, and gear pump assembly have outer dimensions of approximately 3¾ to 6 inches.

15. The debris removal apparatus of claim 10 wherein the intake housing includes four intake ports.

16. A method for pumping fluid comprising the steps of:

providing a debris removal apparatus for a pumping system comprising, in combination:

a top drive gear assembly;

a bottom drive gear assembly;

a gear pump assembly interposed between the top drive gear assembly and the bottom drive gear assembly;

an auger;

a cyclone housing positioned over a shaft of the auger and adapted to contain a cyclone screen, wherein the cyclone housing is interposed between a blade of the auger and the bottom drive gear assembly;

the cyclone screen positioned within the cyclone housing; and an intake housing positioned over the blade of the auger, wherein the intake housing includes at least one intake port;

utilizing the debris removal apparatus, pumping fluid;

wherein the fluid enters the intake housing, then enters an interior portion of the cyclone screen;

causing solids entrained in the fluid to exit the cyclone screen through openings in the cyclone screen, to then pass through a length of exhaust channels, to then exit the debris removal apparatus;

wherein the fluid then passes through the bottom drive gear assembly, then enters the gear pump assembly; and wherein a portion of the fluid then enters the top drive gear assembly.

17. The method of claim 16 further comprising positioning a transmission housing at a north end of the auger and positioning an opening proximate the transmission housing, permitting gasses contained in the fluid to exit through the opening while the fluid is being pumped.

18. The method of claim 16 wherein the gear pump assembly comprises at least two gears, wherein the gears include teeth, the teeth having cavities; and causing debris entrained in the fluid to be trapped in the cavities when the fluid passes through the gear pump assembly.

19. The method of claim 16 further comprising configuring the debris removal apparatus to pump fluid through the gear pump assembly at a slower rate than pumping fluid through the intake housing.

20. The method of claim 16 further comprising causing pumped fluid that is beyond a capacity of the gear pump assembly to exit the debris removal apparatus.

* * * * *